US005629280A

United States Patent [19]

Richter et al.

[11] Patent Number: 5,629,280

[45] Date of Patent: May 13, 1997

[54] GERMICIDAL PINE OIL CLEANING COMPOSITIONS

[75] Inventors: Alan F. Richter, Branchburg; Frederic A. Taraschi, River Vale, both of N.J.

[73] Assignee: Reckitt & Colman Inc., Montvale, N.J.

[21] Appl. No.: 523,412

[22] Filed: Sep. 5, 1995

[30] Foreign Application Priority Data

Aug. 4, 1995 [GB] United Kingdom ..... 9516081

[51] Int. Cl.[6] ..... C11D 1/08; C11D 1/62; C11D 3/20; C11D 3/48

[52] U.S. Cl. ..... 510/463; 510/433; 510/423; 510/434; 510/477; 510/479; 510/490; 510/504

[58] Field of Search ..... 252/547, 546, 252/174.21, 551, 170, 162; 510/463, 433, 423, 434, 477, 479, 490, 504

[56] References Cited

U.S. PATENT DOCUMENTS

| | | | |
|---|---|---|---|
| H269 | 5/1987 | Malik | 422/37 |
| 4,533,485 | 8/1985 | O'Connor et al. | 252/156 |
| 4,540,505 | 9/1985 | Frazier | 252/106 |
| 4,597,887 | 7/1986 | Colodney et al. | 252/106 |
| 4,601,954 | 7/1986 | Coleman | 428/522 |
| 5,376,298 | 12/1994 | Michael | 252/153 |
| 5,378,409 | 1/1995 | Ofosu-Asante | 252/548 |
| 5,435,935 | 7/1995 | Kupneski | 252/156 |
| 5,523,025 | 6/1996 | Erilli | 252/550 |

FOREIGN PATENT DOCUMENTS

| | | |
|---|---|---|
| 1153267 | 9/1983 | Canada . |
| 1470384 | 4/1977 | United Kingdom . |

OTHER PUBLICATIONS

GB Search Report for GB Appn. GB 9516081.8 dated 18 Jan. 1996.

*Primary Examiner*—Michael P. Tierney
*Attorney, Agent, or Firm*—Frederick H. Rabin; Andrew N. Parfomak

[57] ABSTRACT

A pine oil type cleaning concentrate composition comprising as essential constituents: pine oil, one or more pine oil solubilizing agents, cationic surfactant, anionic surfactant, a surfactant compatibilizing agent, and water. Compositions according to the invention feature reduced levels of volatile organic contents, including reduced amounts of pine oil, yet provide good blooming characteristics upon mixing of the concentrate composition with a further amount of water to produce a cleaning composition therefrom. The pine oil cleaning compositions may further include conventional additives, including germicidal agents, viscosity modification agents, fragrances (natural or synthetically produced), foaming agents, detersive agent, co-surfactants, and coloring agents.

10 Claims, No Drawings

GERMICIDAL PINE OIL CLEANING COMPOSITIONS

The present invention relates to improvements in cleaning compositions. More particularly, the present invention is directed to improved pine oil type cleaning compositions and concentrates thereof, which find particular use in hard surface cleaning applications.

Cleaning compositions are commercially important products and enjoy a wide field of utility in assisting in the removal of dirt and grime from surfaces, especially those characterized as useful with "hard surfaces". One particular category of cleaning compositions are those which are classed as pine oil type cleaning compositions which typically include one or more of the following identifying characteristics: containing an amount of one or more resins or oils derived from coniferous species of trees; containing synthetic fragrance compositions which are intended to mimic the scent of of one or more resins or oils derived from coniferous species of trees; a color ranging from colorless to a deep amber, deep amber yellow or deep amber reddish color; generation of a milky or cloudy appearance when diluted with water in dilutions useful for cleaning applications. Such pine oil type cleaning compositions are generally provided in a concentrated composition which is subsequently diluted with water by an end user/consumer to form a cleaning composition therefrom.

While such pine oil type cleaning compositions are commercially significant and in popular use, their use is not without attendant shortcomings. For example, high levels of pine oil in a cleaning composition are known to leave undesirable surface residues, particularly on hard surfaces. This effect may be minimized by the addition of further constituents, such as the use of certain surfactants which are useful in solubilizing and stabilizing the the pine oil. However, such a solution raises further problems as many useful surfactants, and frequently the pine oil itself, are categorized as undesired volatile organic compounds ("VOC"). Thus, there is need in the art for providing improved pine oil type cleaning compositions which exhibit one or more of the identifying characteristics outlined above which are important indicia for consumer acceptance, while at the same time providing a reduction in the content of undesired volatile organic compounds which are often used in commercially available pine oil type cleaning compositions.

Various formulations directed to the production of pine oil type cleaners with reduced pine oil content have been proposed. For example, CA 1153267 teaches a pine oil type cleaning composition which includes 0 to 8% by weight pine oil, but which also requires that a minimum of 5.6% by weight alpha terpineol be present. Further, CA 1120820 describes disinfecting pine oil type cleaning composition which includes among other essential constituents, from 5 to 30 percent by weight of pine oil. While advantageous, these compositions as well as other art known compostions and formulations are not without attendant shortcomings, certain shortcomings which the present applicant addresses.

It is therefore among the objects of the invention to provide a cleaning compositions and concentrates thereof which exhibit one or more of the identifying characteristics of pine oil type cleaning compositions described above, particularly those which exhibit reduced amounts of volatile organic compounds ("VOCs").

It is further object of the invention to provide commercially acceptable shelf stable concentrated cleaning compositions which exhibit one or more of the identifying characteristics of pine oil type cleaning compositions described above, (particularly those which exhibit reduced amounts of VOC), which concentrated cleaning compositions are readily dilutable with water to form useful cleaning compositions.

A still further object of the invention is the provision of cleaning compositions and concentrates which exhibit one or more of the identifying characteristics of pine oil type cleaning compositions described above, particularly those which exhibit reduced amounts of volatile organic compounds, which composition further include one or more constituents which impart a disinfectant properties to the cleaning compositions.

A yet further object of the invention is the provision of pourable concentrated cleaning compositions exhibit one or more of the identifying characteristics of pine oil type cleaning compositions described above which are readily dilutable in water.

These and other objects of the invention will become apparent from the following detailed description of the invention.

The compositions according to the invention comprise the following constituents:

Constituent A): pine oil;
Constituent B): pine oil solubilizing agents;
Constituent C): cationic surfactant;
Constituent D): anionic surfactant
Constituent E): surfactant compatibilizing agent;
Constituent F): water.

The compositions according to the invention may comprise further optional constituents which include fragrances, coloring agents, water softening agents as well as other conventional additives.

The inventors have found that it is now possible to produce certain concentrate compositions utilizing these selected constituents in particular formulations which provide pine oil type cleaning compositions in a concentrated liquid form which unlike many known prior art composition contain only a very small fraction of pine oil as an active constituent, as well as a small amount of undesired VOCs. Surprisingly however, these inventive compositions still exhibit many of the desirable characteristics of pine oil type cleaning compositions described above, especially "blooming". This is an important and surprising feature of the invention as the use of relatively higher amounts of pine oil in cleaning concentrate compositions is known as a requirement to produce the desirable "blooming" effect when such concentrates are further diluted with water. The "blooming" observed may be described as the change of the water's appearance from essentially colorless and transparent to that of a milky white or milky yellowish white, cloudy appearance. Such blooming is a highly desirable in such pine oil type cleaning compositions as consumer/end user expectations associate cleaning effectiveness with the extent and degree of this blooming upon formation of a cleaning composition. That such behaviour is achieved in the compositions according to the present invention, which also feature relatively low amounts of pine oil and other volatile organic compounds, is surprising. Concommitantly, in the concentrate compositions according to the invention, the reduction in the overall amounts of pine oil and the necessary compatibilizing agents required provides the benefits of reduced volatile organic content of a concentrate or cleaning composition, as well as reduce the propensity of such compositions to form undesirable residues upon cleaned surfaces.

Constituent A

Compositions according to the invention comprise a pine oil constitutent. Pine oil is a complex blend of oils, alcohols, acids, esters, aldehydes and other organic compounds. These include terpenes which include a large number of related alcohols or ketones. Some important constituents include terpineol, which is one of three isomeric alcohols having the basic molecular formula $C_{10}H_{17}OH$. One type of pine oil, synthetic pine oil, will generally have a specific gravity, at 15.5° C. of about 0.9300, which is lower than the two other grades of pine oil, namely steam distilled and sulfate pine oils, and will generally contain a higher content of turpentine alcohols. Other important compounds include alpha- and beta-pinene (turpentine), abietic acid (rosin), and other isoprene derivatives.

Particularly effective pine oils which are presently commercially available include Unipine® 60 (from Union Camp, which is believed to contain approximately 60% terpene alcohols), Unipine® S-70 and Unipine® S-70 (from Union Camp, both are believed to contain approximately 70% terpene alcohols), Unipine® S and Unipine® 80 (from Union Camp, both are believed to contain approximately 80% terpene alcohols), Unipine® 80 (from Union Camp, which is believed to contain approximately 80% terpene alcohols), Unipine® 85 (from Union Camp, which is believed to contain approximately 85% terpene alcohols), Unipine® 90 (from Union Camp, which is believed to contain approximately 90% terpene alcohols), as well as Alpha Terpineol 90 (from Union Camp, which is believed to contain approximately 100% terpene alcohols). Futher effective pine oils include Glidco® Pine Oil™ 60 (available from Glidco Organics Corp., Jacksonville, Fla., believed to contain approximately 60% terpene alcohols), Glidco® Pine Oil 60 (available from Glidco Organics Corp., Jacksonville, Fla., believed to contain approximately 60% terpene alcohols); Glidco® Pine Oil 140 (available from Glidco Organics Corp., Jacksonville, Fla., believed to contain approximately 70% terpene alcohols); Glidco® Pine Oil 80 (available from Glidco Organics Corp., Jacksonville, Fla., believed to contain approximately 80% terpene alcohols) Glidco® Pine Oil 150 (available from Glidco Organics Corp., Jacksonville, Fla., believed to contain approximately 85% terpene alcohols); Glidco® Terpene SW (available from Glidco Organics Corp., Jacksonville, Fla., believed to contain approximately 75% terpene alcohols); as well as Glidco® Terpineol 350 (available from Glidco Organics Corp., Jacksonville, Fla., believed to contain approximately 100% terpene alcohols). Other products which can contain up to 100% pure alpha-terpineol, may also be used in the present invention.

The pine oil constituent may be present in the concentrate compostions in amounts of up to about 3% by weight, preferably in amounts of up to 0.01–2.5% by weight, but most preferably in amount of between 0.75–1.5% pine oil by weight. As with all of the weight percentages of the constituents described, the weight percentages are indicative of the weight percentages of the actives in a constituent containing preparation.

Constituent B

A further constituent according to the invention is a pine oil solubilizing agent, which assists in improving the dispersability of the pine oil constituent in water, but which also is found not to substantially interfere or detract from the blooming characteristics provided by the invention. Many useful pine oil solubilizing agents are well known to the art, many of which are based on organic compounds. Any which exhibit effective pine oil solubilization and which do not detract from the invention, particularly the blooming characteristics of the invention, may be used. Mixtures of two or more pine oil solubilizing agents may also be used.

Exemplary pine oil solubilizing agents include certain nonionic alkoxylated linear alcohol surfactants which exhibit the above described properties. Such alkoxylated alcohol nonionic surfactants are known, and may be commercially obtained from the Olin Chemical Co., (Stamford, Conn.) under the product line name of "Poly-Tergent®". Particular members of this product line which have been found useful include; Poly-Tergent® SL-42 and Poly-Tergent® SL-62.

Further exemplary pine oil solubilizing agents include $C_1$–$C_8$ alcohols, especially $C_1$–$C_3$ alcohols, of which isopropanol is preferred.

While the exact amont of the pine oil solubilizing agent required to effectively solubilize the pine oil constituent may vary from composition to composition, it has generally been found that relatively small amounts of the pine oil contemplated in the compositions would generally require a concommitantly small amount of the pine oil solubilizing agent. Pine oil solubilizing agent in amounts of 15% by weight and less have been found to be effective to solubilize the pine oil, as well as optionally solubilizing other constituents which may be present in the concentrate compositions of the invention. Preferably, the pine oil solubilizing agent in amounts of 15% and less by weight, preferably 0.01–10% by weight, and most preferably 0.1–5% by weight are used in the compositions.

Constituent C

The concentrate compositions according to the invention include as a necessary constituent at least one cationic surfactant which is found to be demonstrate the blooming features taught herein when combined with an effective amount of Constituent D, which may thereafter be solubilized by the addition of Constituent E, as described below. Any cationic surfactant which satisfies these requirements may be used and are considered to be within the scope of the present invention, and mixtures of two or more cationic surface active agents, viz., cationic surfactants may also be used. Cationic surfacants are well known, and useful cationic surfactants may be one or more of those described for example in *McCutcheon's Detergents and Emulsifiers*, North American Edition, 1982; *Kirk-Othmer, Encyclopedia of Chemical Technology*, 3rd Ed., Vol. 22, pp. 346–387, the contents of which are herein incorporated by reference.

Examples of preferred cationic surfactant compositions useful in the practice of the instant invention include quarternary ammonium compounds and salts thereof include quarternary ammonium germicides which may be characterized by the general structural formula:

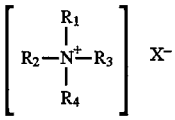

where at least one or $R_1$, $R_2$, $R_3$ and $R_4$ is a hydrophobic, aliphatic, aryl aliphatic or a aliphatic aryl radical of from 6 to 26 carbon atoms, and the entire cation portion of the molecule has a molecular weight of at least 165. The hydrophobic radicals may be long-chain alkyl, long-chain alkoxy aryl, long-chain alkyl aryl, halogen-substitued long-chain alkyl aryl, long-chain alkyl phenoxy alkyl, aryl alkyl, etc. The remaining radicals on the nitrogen atoms other than the hydrophobic radicals are substituents of a hydrocarbon structure usually containing a total of no more than 12 carbon atoms. The radicals $R_1$, $R_2$, $R_3$ and $R_4$ may be straight chained or may be branched, but are preferably straight chained, and may include one or more amide or ester linkages. The radical X may be any salt-forming anionic radical.

Exemplary quarternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quarternary ammonium salts include those in which the molecule contains either amide or ester linkages such as octyl phenoxy ethoxy ethyl dimethyl benzyl ammonium chloride, N-(laurylcocoaminoformylmethyl)-pyridinium chloride, and the like. Other very effective types of quarternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quarternary ammonium compounds which act as germicides and which are be found useful in the practice of the present invention include those which have the structural formula:

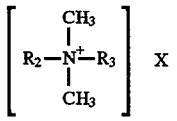

wherein $R_2$ and $R_3$ are the same or different $C_8$–$C_{12}$alkyl, or $R_2$ is $C_{12-16}$alkyl, $C_{8-18}$alkylethoxy, $C_{8-18}$alkylphenolethoxy and $R_3$ is benzyl, and X is a halide, for example chloride, bromide or iodide, or methosulfate. The alkyl groups recited in $R_2$ and $R_3$ may be straight chained or branched, but are preferably substantially linear.

Such quartenary germicides are usually sold as mixtures of two or more different quartenaries, such as BARDAC® 205M, (presently commercially available from Lonza, Inc., Fairlawn, N.J.) which is believed to be a 50% aqueous solution containing 20% by weight of an alkyl dimethyl benzylammonium chloride (50% C14, 40% C16 alkyl); 15% by weight of an octyl decyl dimethylammonium chloride; 7.5% by weight of dioctyl dimethylammonium chloride; and 7.5% by weight of didecyl dimethylammonium chloride. A further useful quarternary germicide is CYNCAL® 80% (presently commercially available from Hilton Davis Chemical Co., Cincinnati, Ohio) which is believed to comprise 80% by weight of an alkyl dimethyl benzylammonium chloride (50% C14, 40% C12 and 10% C16 alkyl), 10% water and 10% ethanol. Further useful quarternary germicidal agents include BTC-8358®, an alkyl benzyl dimethyl ammonium chloride (80% active) and BTC-818®, a dialkyl dimethyl ammonium chloride (both presently commercially available from the Stepan Chemical Co., Chicago, Ill.). Additional suitable commercially available quarternary ammonium germicides of the alkyl dimethyl benzylammonium chloride type containing the same alkyl dimethyl benzylammonium chloride mixture as that of CYNCAL® and which are generally referred to as quarternium salts include BARQUAT® MB-80, (presently commercially available from Lonza, Inc., Fairlawn, N.J.) which is believed to be and 80% by weight solution (20% ethanol) of the quarternary, HYAMINE® 1622 believed to be an aqueous solution of benzethonium chloride, and HYAMINE® 3500, which is believed to be a 50% aqueous solution of the quarternary ( both presently commercially available from Lonza Inc., Fairlawn, N.J.).

The cationic surfactant may be present in any amount which are found to exhibit the desirable characteristics of the invention, particularly that of a relatively clear appearance in concentrated solution, as well as blooming when diluted with further water to form a cleaning composition. In preferred compositions, in addition to the blooming characteristics produced in conjunction with the anionic surfactant and the surfactant compatabilizing agent, the cationic surfactant also exhibits germicidal activity as is noted above. Generally, this cationic surfactant is present in the concentrate compostions in amounts of 5% by weight and less, preferably in amounts of 0.1–4% by weight, but most preferably in amount of 1–2% by weight. It has been found by the inventors that the preferred amounts are in part dictated by toxocological considerations as an excess of the cationic component may pose an increasing risk of irritation to the eyes, skin and mucocous tissues of a consumer. The preferred amounts are also in part dicated by economic considerations as an excess of the cationic component above these amounts generally requires a corresponding increase in the amount of the anionic component.

Constituent D

A further essential constituent of compostions according to the present invention includes an anionic surface active agent. Any anionic surface active agent, viz., anionic surfactant may utilized which is found to be effective in forming a water insoluble or poorly miscible complex when mixed with the Constituent C, which due to said insolubility or poor miscibility of the formed complex, renders an aqueous mixture containing Constituent C and D, nontransparent, but preferably renders such an aqueous mixture turgid, milky or cloudy.

The inventors have found that certain carboxylated alcohol alkoxylate compounds effective as surfactants satisfy the requirements 1) and 2) noted above and are advantageously incorporated into the concentrate compositions of the invention as Constituent D. These include carboxylated alcohol alkoxylate surfactants according to the following general formula:

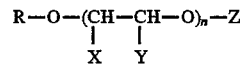

wherein R is a hydrophobic group, more preferably a $C_6$–$C_{18}$ alkyl group, n is a number in the range of 1 to 24, X and Y are independently selected from the group consisting of hydrogen, succinic acid radical, hydroxysuccinic acid radical, citric acid radical, and mixtures thereof, wherein at least one of X or Y is a succinic acid radical, hydroxysuccinic acid radical, or citric acid radical and Z is H or —$CH_2COOH$. Certain anionic surfactants according to the immediately preceeding general formula are presently commercially available as the Poly-Tergent® C series of anionic surfactants from the Olin Chem. Co., ( Stamford, Conn.). Particularly preferred amongst these are the Poly-Tergent™ CS-1 composition which is believed to being a composition according to the formula above wherein R is a $C_6$–$C_{18}$ alkyl group, X and Y are independently H, $CH_3$ or the succinic acid radical with at least one succinic acid radical being present and where Z is H.

Other known anionic surfactants while not particularly enumerated here may also find use as Constituent D of the present inventive compositions. Also, mixtures of one or more anionic surfactants may be used as Constituent D.

Constituent D may be present in any amount which is found to exhibit the desirable characteristics of the invention that of a relatively clear appearance in concentrated solution but that of blooming when diluted with further water to form a cleaning composition. Generally, this anionic surface active agent is present in concentrate compostions in amounts of up to about 5% by weight, preferably in amounts of 0.1–5% by weight, but most preferably in amount of between 1 and 3.5% by weight.

Particular attention is to be paid to the relative proportions of the cationic surfactant to the anionic surfactant in the compositions according to the invention, as it is a feature of the invention that both the cationic surfactant of Constituent C and the anionic surfactant of Constituent D be present in such amounts such that the concentrate composition be relatively clear when present in the concentrate composition, which concentrate compostion comprises a solubilizing effective amount of Constituent E, a surfactant compatiblizing agent. In the aqueous concentrate compositions according to the invention, Constituent E is present in amount sufficient to solubilize the amounts of Constituent C and D which are present in said concentrate composition. Such a concentrate composition is relatively clear and is preferably transparent. However, upon the addition of the said concentrate composition to a further amount of water, the solubility of the cationic surfactant and the anionic surfactant in the new volume of water is sufficinetly reduced or disrupted which causes the appearance of the now diluted concentrate composition to become turgid, or cloudy and thus imitate the "blooming" behaviour of prior art pine oil cleaner type compositions. While not wishing to be bound by any theory, it is hypothesized that in the absence of a sufficient amount of a Constituent E, the surfactant compatabilizing agent, the pendant carboxylic acid or carboxylic acid moieties of the preferred species of anionic surfactants effectively complex with the quarternary ammonium in the quarternary ammonium compound and become insoluble or immiscible in an aqueous mixture, which then become visible due to the presence of the sufficiently long alkyl chain moieties which also constitute part of the preferred anionic surfactants. This effect may however be reversed by the addition of an additional, sufficient amount of the surfactant compatibilizing agent to such a mixture, which addition solubilizes at least the anionic surfactant and/or the complexed cationic and anionic surfactants. Such solubilization effectively restores the clear appearance of the aqueous mixture containing the cationic and anionic surfactants. It is contemplated that other anionic surface active agents having a first functional portion or group effective in forming a complex with the quarternary ammonium compound in water, and which has a second functional portion or group which is hydrophobic in nature and which is insoluble or poorly miscible in water when such a complex is formed and in the absence of any further compatabilizing agent(s) become visible to the eye, may also be used.

Constituent E

In order to ensure the solubility of the cationic surfactant of Constituent C and the anionic surface active agent of Constituent D, the present inventors have found that an effective amount of a surfactant compatibilizing agent which is shown to be effective in increasing the miscibility or solubility of the selected Constituents C and D in water, yet evidence no detrimental effect with respect to the blooming behaviour of the concentrate composition, need to be included in the concentrate compositions according to the invention.

One class of such useful surfactant compatibilizing agents are water soluble salts including, but not limited to monovalent alkali and/or polyvalent alkaline earth metal salts and ammonium salts. Non-limiting examples of such useful salts include: NaCl, $MgCl_2$, $NaHCO_3$, $Na_2CO_3$, $NH_4Cl$.

A further class of useful surfactant compatabilizing agents include certain amphoteric surfactants. Useful amphoteric surfactants include betaine compounds which exhibit the following general formula:

$$R-\overset{(+)}{N}(R_1)_2-R_2\overset{(-)}{C}OO$$

wherein R is a hydrophobic group selected from the group selected from alkyl groups containing from about 10 to about 22 carbon atoms, preferably from about 12 to about 18 carbon atoms, alkylaryl and arylalkyl groups containing a similar number of carbon atoms with a benzene ring being treated as equivalent to about 2 carbon atoms, and similar structures interrupted by amido or ether linkages; each $R_1$ is an alkyl group containing from 1 to about 3 carbon atoms; and $R_2$ is an alkylene group containing from 1 to about 6 carbon atoms.

Examples of preferred betaines include lauramidopropyl betaine, a commercial preparation of which is available under the tradename Mirataine® BB (from Rhône-Poulenc, Cherry Hill, N.J.), and cocamidopropyl betaine available under the trade name Mackam™ DZ (from McIntyre Group Ltd., University Park, Ill.).

Effective amounts of the surfactant compatabilizing agent may be any amount which, when added to the aqueous concentrate mixture of Constituents A, B, C, and D (and F) improve the miscibility of Constituents C and D in water, but do not diminish the blooming characteristic of the concentrate composition when it is added to water. The present inventors have found that in the concentrate compositions according to the invention, such an effective amount may be a relatively small amount, and good compatibilizing behaviour has been observed with amounts of 10% by weight and less, with preferred amounts being 0.01–6% by. While amount less than 6% are to be preferred from an economic standpoint, it is to be understood that other amounts, including those greater than 6% by weight may be necessitated due to the selected Constituents C and D, their relative amounts used, and their miscibility in water.

The present inventors have also found that certain concentrate compositions, including certain concentrate compostions comprising betaines, may be produced wherein the Constituent E is present in a sufficient amount wherein it acts as both a surfactant compatabilizing agent (Constituent E) and as an effective pine oil solubilizing agent (Constituent B). In such compositions wherein Constituent E is present in sufficient amounts to fulfill both these functions, it may be present in any effective amount, but preferably is present in a weight percentage amounts equal to the sum of the Constituent B and Constitutent E amounts recited above, viz., 25% although it is desirably present in a substantially lesser amount, most preferably 0.02–10% by weight. In such composition, all or part of the Constituent B need not be present within a concentrate composition, thus offering a further reduction in the overall VOC content of such a concentrate composition.

Constituent F

Water is added to Constituent A, B, C, D and in order to provide 100% by weight of the concentrate composition. The water may be tap water, but is preferably distilled and/or deionized water. If the water is tap water, it is preferably appropriately filtered in order to remove any undesirable impurities such as organics or inorganics, especially minerals salts which are present in hard water which may thus interfere with the operation of Constituents A–E, as well as any other optional components of the liquid concentrates according to the invention.

Water is added in amounts which are sufficient to form the concentrated compositions which amount is sufficient to ensure the retention of a substantially clear characteristic when produced as a concentrate, but at the same time ensuring good blooming upon the addition of the concentrated composition to a further amount of water, or upon the addition of further water to the concentrate. This amount may be readily determined by first mixing measured amount of Constituents A, B, C, D and when used, E in a vessel and then during stirring adding water. The minimum amount of water is that which is required to form a mixture of Constituents A–E, and an excess of water is the amount of water which is added at which the "blooming" of the mixture appears. Generally, water is present in the concentrate compostions in amounts in excess of about 50% by weight, preferably in amounts of in excess of 70% by weight, but most preferably in amount of between 80% to 92% by weight based on the total weight of Constituents A–E in the concentrate compositions according to the invention.

Further optional, but desirable constituent include fragrances, natural or synthetically produced containing synthetic fragrance compositions, especially those which are intended to mimic the scent of one or more resins or oils derived from coniferous species of trees, viz., a scent characteristic of pine oil type cleaning concentrates. Such fragrances may be added in any conventional manner, admixing to a concentrate composition or blending with other constituents used to form a concentrate composition, in amounts which are found to be useful to enhance or impart the desired scent characteristic to the concentrate composition, and/or to cleaning compositions formed therefrom. Fragrance effects atypical of pine oil type cleaning concentrates may be used as well.

Further optional, but advantageously included constituents are one or more coloring agents which find use in modifying the appearance of the concentrate compositions and enhance their appearance from the perspective of a consumer or other end user. Known coloring agents, may be incorporated in the compostions in effective amount to improve or impart to concentrate compositions an appearance characteristic of a pine oil type concentrate composition, such as a color ranging from colorless to a deep amber, deep amber yellow or deep amber reddish color. Such a coloring agent or coloring agents may be added in any useful amount in a conventional fashion, i.e., admixing to a concentrate composition or blending with other constituents used to form a concentrate composition. However, other colors atypical of pine oil type cleaning concentrates may be used as well.

Other conventional additives known to the art but not expressly enumerated here may also be included in the compositons according to the invention. By way of non-limiting example these may include viscosity modification agents, fragrances (natural or synthetically produced), foaming agents, further surfactants including anionic, cationic, non-ionic, amphoteric and zwitterionic surfactants, especially those useful in providing further detersive effects, and coloring agents, and water softening agents. Such further surfactants denoted here are conventionally known; exemplary compositions are described in *McCutcheon's Detergents and Emulsifiers*, North American Edition, 1982; *Kirk-Othmer, Encyclopedia of Chemical Technology*, 3rd Ed., Vol. 22, pp. 346–387, the contents of which are herein incorporated by reference. Mixtures of two or more such surface active agents may be incorporated into the inventive compositions. Such optional, i.e., non-essential constituents should be selected so to have little or no detrimental effect upon the blooming behaviour provided by the inventive compostions, and generally the total weight of such further conventional additives may comprise up to 20% by weight of a concentrated composition formulation.

What is to be understood by the term "concentrate" and "concentrate composition" in this specification and claims is the pre-consumer dilution and composition of the cleaning composition which is the essentially the form of the product prepared for sale to the consumer or other end user. Such a consumer or other end user would then normally be expected to dilute the same with water to form a cleaning composition. It is to be understood however that nothing in this invention would bar its use as cleaning composition without any further dilution and it may be used in the concentrations in which it was prepared for sale. Similarly, what is to be understood by the term "cleaning compositions" are the water diluted compositions which are expected to be prepared by the consumer or other end user by mixing a measured amount of the "concentrate" with water in order to form an appropriately diluted cleaning composition which is suitable for use in cleaning applications, especially in the cleaning of hard surfaces.

As generally denoted above, the formulations according to the invention include both cleaning compositions and concentrates as outlined above which differ only in the relative proportion of water to that of the other constituents forming such formulations. While the concentrated form of the cleaning compositions find use in their original form, they are more frequently used in the formation of a cleaning composition therefrom. Such may be easily prepared by diluting measured amounts of the concentrate compositions in water by the consumer or other end user in certain weight ratios of concentrate:water, and optionally, agitating the same to ensure even distribution of the concentrate in the water. As noted, the concentrate may be used without dilution, i.e., in concentrate:water concentrations of 1:0, to extremely dilute dilutions such as 1:10,000. Desirably, the concentrate is diluted in the range of 1:0.1–1:1000, preferably in the range of 1:1–1:500 but most preferably in the range of 1:10–1:100. The actual dilution selected is in part determinable by the degree and amount of dirt and grime to be removed from a surface(s), the amount of mechanical force imparted to remove the same, as well as the observed efficacy of a particular dilution. Generally better results and faster removal is to be expected at lower relative dilutions of the concentrate in water.

EXAMPLE FORMULATIONS

Preparation of Example Formulations

Exemplary formulations according to the instant invention were prepared in accordance with the following general procedure.

Into a suitably sized vessel, the following constituents were added in the sequence: F, C, E, D, A, B, but order the order of mixing is not critical in order to achieve concentrate compositions exhibiting the desired results. All of the constituents were supplied at room temperature, and mixing of the constituents was achieved by the use of a magnetic stirrer. Mixing, which generally lasted from 1 minute to 5 minutes, was maintained until the particular exemplary formulation attained uniform color and uniform clarity. Each of the formulations exhibited the following physical characteristics: transparent appearance, light to medium amber yellow color, and a noticeable pine oil odor. The exemplary compositions were readily pourable, and retained well mixed characteristics (i.e., stable mixtures) upon standing for periods in excess of several weeks.

The exact compositions of the example formulations are listed on Table 1, below. Example Formulation 8 illustrates a composition werein a sufficient amount of Component D was found effective in solubilizing both the surfactant composition as well as the pine oil constituent, thus dispensing the need for Component B.

TABLE 1

EXAMPLE FORMULATIONS

| [Constituent] Name | Example Formulation: (in % weight) | | | | | | | | |
|---|---|---|---|---|---|---|---|---|---|
| | Ex. 1 | Ex. 2 | Ex. 3 | Ex. 4 | Ex. 5 | Ex. 6 | Ex. 7 | Ex. 8 | Ex. 9 |
| [A] Pine Oil 60 | 1.0 | 1.0 | 1.0 | 1.0 | 1.0 | 1.0 | 1.0 | 1.0 | 3.0 |
| [B] Poly-Tergent ® SL-62 | 2.6 | 2.0 | 2.1 | — | 4.0 | 1.6 | 1.6 | — | 6.43 |
| [B] isopropyl alcohol | — | — | — | 15 | — | — | — | — | — |
| [C] BTC 8358 | 1.5 | 1.5 | 1.5 | 1.5 | 1.9 | 2.5 | 1.2 | 1.5 | 1.5 |
| [C] BTC 818 | 0.6 | 0.6 | 0.6 | 0.6 | — | — | 0.6 | 0.6 | 0.6 |
| [D] Poly-Tergent ® CS-1 | 3.0 | 3.0 | 3.0 | 3.0 | 3.0 | 3.0 | 3.0 | 3.0 | 3.0 |
| [E] sodium chloride | 1.7 | — | — | — | 1.2 | — | — | — | — |
| [E] magnesium chloride hexahydrate | — | 0.8 | — | — | — | — | — | — | — |
| [E] sodium bicarbonate | — | — | 2.7 | — | — | — | — | — | — |
| [E] Mackam DZ | — | — | — | 5.3 | — | 4.8 | 5.3 | 7.9 | 5.3 |
| [F] deionized water | 89.6 | 91.1 | 89.1 | 73.6 | 88.9 | 87.1 | 87.3 | 86.0 | 80.2 |

Evaluation of Example Formulations

Each of the example formulations was used to prepare an aqueous diluted form therefrom of a concentration and dilution typical of conventionally used cleaning compositions useful in commercial/residential locations. These aqueous dilutions were simply prepared by pouring one part by weight of each example formulation into 63 parts by weight of tap water (1:64 by weight dilution) at 20° C. and at 40° C.

In each case, the addition of an example formulation to the water was accompanied by a change in the appearance of the water from transparent to a translucent cloudy, whitish appearance.

These aqueous dilutions were prepared to evaluate the degree of light transmittance, a measure of the opacity as well as of the blooming of each of the aqueous dilutions. Certain of these aqueous dilutions were also evaluated to determine the antimicrobal efficacy of the aqueous dilution. The results of the light transmittance evaluation was determined as a percentage of light transmitted through a sample of a particular aqueous dilution wherein the transmisson of a like sample of water is assigned a percentage of 100%. Testing was performed by mixing a 5 g aliquot of a particular example formulation with 315 g of tap water (with approx. 100 ppm hardness), after which the sample was mixed for 60 seconds and a transmittance reading at 620 nm wavelength was taken using a Brinkman model PC801 dipping probe colorimeter, which was set at 620 nm to determine the light transmission of eash of the samples. Samples of each formulation at 20° C. and at 40° C. were evaluated, as well as the reference (pure tap water) sample used to calibrate the colorimeter to the reference 100% light transmission sample outlined above. The resulting determined values, reported as "Blooming" in Table 2 below provide an empirical evaluation, reported in percent transmittance ("%") of the degree of transparency of a diluted example formulation wherein 0% indicates complete opacity and 100% the transparency of a water sample as noted above. Accordingly, those results indicative of lower transmittance values identify samples exhibiting desirable turgid or cloudy appearances.

TABLE 2

TEST RESULTS

| Dilution of Example Formulation: | Blooming at 20° C. (%) | Blooming at 40° C. (%) | Antimicrobal Efficacy *Staphylococcus aureus* | Antimicrobal Efficacy *Salmonella choleraesuis* |
|---|---|---|---|---|
| Ex. 1 | 13.0 | 10.4 | (n.t.) | (n.t.) |
| Ex. 2 | 10.0 | 8.2 | (n.t.) | (n.t.) |
| Ex. 3 | 11.1 | 8.7 | (n.t.) | (n.t.) |
| Ex. 4 | 15.8 | 13.1 | (n.t.) | (n.t.) |
| Ex. 5 | 53.7 | 8.6 | 1/60 | 1/60 |
| Ex. 6 | 15.4 | 7.8 | 1/60 | 1/60 |
| Ex. 7 | 71.8 | 14.8 | 0/30 | 0/30 |
| Ex. 8 | 35.6 | 100.2 | (n.t.) | (n.t.) |
| Ex. 9 | 17.2 | 22.9 | (n.t.) | (n.t.) |

Formulations not tested for Antimicrobal Efficacy are indicated as "(n.t.)".

Antimicrobal efficacy of certain of prepared dilutions was also evaluated against two representative bacterial species, *Salmonella choleraesuis* and *Staphflococcus aureus*. As is known in the art, each of these bacterial species is commonly found and is desirably removed or destroyed during a cleaning procedure of such environments.

Antimicrobial efficacy of the prepared dilutions according to examples were evaluated generally in accordance with the standardized AOAC Use-Dilution test method based on AOAC Official Methods of Analysis Procedures 955.14 "Testing disinfectants against *Salmonella Choleraesusis*," and Procedure 955.15 "Testing disinfectants against *Staphylococcus Aureus*" (15th Edition, 1990, pages 135–137, Use Dilution Methods). The results reported on Table 2 indicate the proportion of the number of sample test tubes within which the organism remained alive after 10 minutes of exposure at 20° C. over the total number of test tube samples used in testing the exemplary formulations of Table 1 for their germicidal activity. Example formulations not tested are indicated as "(n.t.)".

As can be seen from the results reported above, the exemplary formulations featured good blooming behaviour and tested formulations also showed good efficacy as germicidal agents.

We claim:

1. A pine oil type cleaning concentrate comprising:

Constituent A): 0.01–3.0% by weight of a pine oil comprising at least 60% alpha-terpineol;

Constituent B): 0.01–15% by weight of a pine oil solubilizing agents selected from the group consisting of a nonionic alkoxylated fatty linear alcohol, and, $C_1$–$C_8$ alcohols;

Constituent C): 0.1–5% by weight of a cationic surfactant exhibiting germicidal activity selected from the group consisting of (I) structures having the formula:

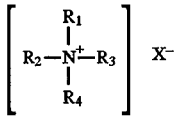

wherein;

(a) at least one of $R_1$, $R_2$, $R_3$ and $R_4$ is selected from the group consisting of aliphatic, aryl aliphatic or aliphatic aryl radical of from 6 to 26 carbon atoms, and any remaining $R_1$, $R_2$, $R_3$ and $R_4$ are hydrocarbons of from 1 to 12 carbon atoms, wherein any of $R_1$, $R_2$, $R_3$ and $R_4$ may be linear or branched, and X is a salt-forming anionic radical; or (b) wherein $R_1$, and $R_4$ are methyl, $R_3$ is benzyl and $R_2$ is selected from the group consisting of $C_{12-16}$ alkyl, $C_{8-18}$ alkylethoxy or $C_{8-18}$ alkylphenolethoxy and X is a salt-forming anionic radical; or (II) N-alkyl pyridinium halides, N-(laurylcocoaminoformylmethyl)-pyridinium chloride, lauryloxyphenyltrimethyl ammonium chloride and cetylaminophenyltrimethyl ammonium methosulfate, X is a salt-forming anionic radical;

Constituent D): 0.1–5 % by weight of a carboxylated alcohol alkoxylate surfactant compound according to the following general formula:

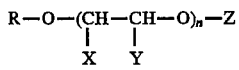

wherein

R is a hydrophobic $C_6$–$C_{18}$ alkyl group, n is 1–24,

X and Y are independently selected from the group consisting of hydrogen, $CH_3$, succinic acid radical, hydroxysuccinic acid radical, citric acid radical, and mixtures thereof, wherein at least X or Y is a succinic acid radical, hydroxy succinic acid radical, citric acid radical or radical, and Z is H or —$CH_2COOH$, Constituent E): 0.1–10% by weight of a surfactant compatibilizing agent selected from water soluble salts, and amphoteric betaine compounds according to the formula:

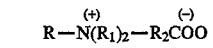

wherein

R is a hydrophobic group selected from alkyl groups containing from about 10 to about 22 carbon atoms, alkyl aryl and aryl alkyl groups containing about 10 to about 22 carbon atoms, where a benzene ring is treated as equivalent to about 2 carbon atoms;

$R_1$ is an alkyl group containing from 1 to about 3 carbon atoms and, $R_2$ is an alkylene group containing from 1 to about 6 carbon atoms;

Constituent F): the remaining balance of up to 100%, water.

2. The pine oil type cleaning concentrate according to claim 1 wherein:

Constituent D) is an anionic carboxylated alcohol alkoxylate surfactant compound according to the following general formula:

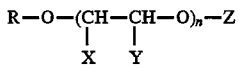

wherein:

R is a hydrophobic $C_6$–$C_{18}$ alkyl group, n is 1–24,

X and Y are independently hydrogen, $CH_3$, succinic acid radical, wherein at least X or Y is a succinic acid radical, and, Z is H.

3. The pine oil type cleaning concentrate according to claim 1 wherein:

Constituent E) is a water soluble salt selected from NaCl, $MgCl_2$, $NaHCO_3$, $Na_2CO_3$, $NH_4Cl$.

4. A pine oil type cleaning concentrate according to claim 1 comprising

Constituent A): 0.01–2.5% by weight of a pine oil comprising at least 60% alpha-terpineol;

Constituent C): 0.1–5% by weight of a cationic surfactant exhibiting germicidal activity according to the structure:

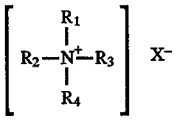

wherein;

$R_1$, and $R_4$ are methyl, $R_2$ and $R_3$ are the same or different $C_{12-16}$ alkyl, or $R_2$ is $C_{8-18}$ alkylethoxy or $C_{8-18}$ alkylphenolethoxy and $R_3$ is benzyl and X is a halide or methosulfate;

Constituent D): 0.1–5 % by weight of a carboxylated alcohol alkoxylate surfactant compound according to the following general formula:

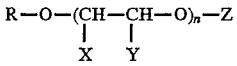

wherein

R is a hydrophobic $C_6$–$C_{18}$ alkyl group, n is 1–24,

X and Y are independently selected from the group consisting of hydrogen, methyl, succinic acid radical, hydroxysuccinic acid radical, citric acid radical, and mixtures thereof, wherein at least X or Y is a succinic acid radical, hydroxy succinic acid radical, citric acid radical or radical, and Z is H or —$CH_2COOH$, Constituent E): 0.02–25% by weight of a surfactant compatibilizing agent selected from water soluble salts, and amphoteric betaine compounds according to the formula:

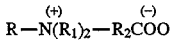

wherein

R is a hydrophobic group selected from; alkyl groups containing from about 10 to about 22 carbon atoms, alkyl aryl and aryl alkyl groups containing about 10 to about 22 carbon atoms, where a benzene ring is treated as equivalent to about 2 carbon atoms;

$R_1$ is an alkyl group containing from 1 to about 3 carbon atoms; and, $R_2$ is an alkylene group containing from 1 to about 6 carbon atoms;

Constituent F): the remaining balance of up to 100%, water.

5. A pine oil type cleaning composition according to claim 1 which further comprises up to 20% by weight based on the total weight of the cleaning composition of one or more nonessential constituents selected from: viscosity modification agents, water softening agents, co-surfactants, and coloring agents.

6. An aqueous cleaning composition comprising the pine oil type cleaning composition according to claim 1 dispersed in water in a weight ratio of from 1:0.1 to 1:1000.

7. A pine oil cleaning composition according to claim 1 wherein the cationic surfactant is a compound of formula I (a) wherein at least one of $R_1$, $R_2$, $R_3$ and $R_4$ is selected from the group consisting of aliphatic, aryl aliphatic or aliphatic aryl radical of from 6 to 26 carbon atoms, and any remaining $R_1$, $R_2$, $R_3$ and $R_4$ are hydrocarbons of from 1 to 12 carbon atoms, wherein any of $R_1$, $R_2$, $R_3$ and $R_4$ may be linear or branched, and X is a salt-forming anionic radical.

8. A pine oil cleaning composition according to claim 1 wherein the cationic surfactant is a compound of formula I (b) wherein $R_1$, and $R_4$ are methyl, $R_3$ is benzyl and $R_2$ is selected from the group consisting of $C_{12-16}$ alkyl, $C_{8-18}$ alkylethoxy or $C_{8-18}$ alkylphenolethoxy and X is a salt-forming anionic radical.

9. A pine oil cleaning composition according to claim 1 wherein the cationic surfactant is a compound selected from the group consisting of N-alkyl pyridinium halides, N-(laurylcocoaminoformylmethyl)-pyridinium chloride, lauryloxyphenyltrimethyl ammonium chloride and cetylaminophenyltrimethyl ammonium methosulfate.

10. A process for process for cleaning and disinfecting a hard surface requiring such treatment which process includes the step of:

applying a cleaning composition according to claim 1 to a hard surface in an amount effective for providing cleaning and/or disinfecting treatment.

* * * * *